US010081216B2

(12) United States Patent
Nishitani et al.

(10) Patent No.: US 10,081,216 B2
(45) Date of Patent: Sep. 25, 2018

(54) INK FILLING TOOL

(71) Applicant: Kuretake Co., Ltd., Nara (JP)

(72) Inventors: Ichiro Nishitani, Nara (JP); Akina Niwa, Nara (JP)

(73) Assignee: Kuretake Co., Ltd., Nara (JP)

( * ) Notice: Subject to any disclaimer, the term of this patent is extended or adjusted under 35 U.S.C. 154(b) by 0 days.

(21) Appl. No.: 15/518,600

(22) PCT Filed: Oct. 14, 2015

(86) PCT No.: PCT/JP2015/079097
§ 371 (c)(1),
(2) Date: Apr. 12, 2017

(87) PCT Pub. No.: WO2016/060187
PCT Pub. Date: Apr. 21, 2016

(65) Prior Publication Data

US 2017/0246901 A1 Aug. 31, 2017

(30) Foreign Application Priority Data

Oct. 16, 2015 (JP) ..... 2014-212004

(51) Int. Cl.
*B43K 11/00* (2006.01)

(52) U.S. Cl.
CPC ..... *B43K 11/00* (2013.01)

(58) Field of Classification Search
CPC ..... B43K 11/00; B43K 8/02
USPC ..... 141/20.5, 23, 351
See application file for complete search history.

(56) References Cited

U.S. PATENT DOCUMENTS 2,130,926 A 9/1938 Nichol
5,511,592 A * 4/1996 Kiel ..... B43L 25/007 141/21
5,518,331 A * 5/1996 Moosmann ..... B43K 5/08 141/20.5
5,678,942 A * 10/1997 Kobayashi ..... B43K 1/086 401/205
5,888,008 A * 3/1999 Obersteller ..... B05B 11/0035 401/119
5,904,432 A * 5/1999 Ando ..... B43K 1/08 401/209
5,906,446 A * 5/1999 McCulloch ..... B43K 8/08 401/198

(Continued)

FOREIGN PATENT DOCUMENTS

CN 1429152 A 7/2003
CN 102971157 A 3/2013

(Continued)

*Primary Examiner* — Timothy L Maust
*Assistant Examiner* — Andrew Schmid
(74) *Attorney, Agent, or Firm* — The Webb Law Firm

(57) ABSTRACT

The present invention provides an ink filling tool including: an ink tank having an internal space configured to store a liquid ink; and a cylindrical nozzle having an inner hole communicating with the internal space of the ink tank, the nozzle being insertable into the through hole. The nozzle is configured to be capable of pressing the valve mechanism which is present inside a pen in a state of being inserted into the through hole, and the nozzle has an ink circulating part configured to communicate the inner hole with an outside in a direction orthogonal to the axis of the nozzle.

4 Claims, 8 Drawing Sheets

(56) References Cited

U.S. PATENT DOCUMENTS 6,536,969 B2 * 3/2003 Nishitani ..... B43K 8/03 401/187
6,807,704 B2 * 10/2004 Nishitani ..... A46B 9/12 15/166
6,817,802 B2 * 11/2004 Nishitani ..... B43K 5/1845 401/205
6,986,620 B2 1/2006 Abbas
7,140,798 B2 * 11/2006 Nakamura ..... B43K 1/08 401/209
8,092,108 B2 1/2012 Bainbridge et al.
8,282,299 B2 * 10/2012 Ito ..... B43K 1/086 401/195
8,408,831 B2 * 4/2013 Paradise ..... B43K 23/00 401/131
9,247,773 B2 * 2/2016 Memari ..... A24F 15/12
9,688,092 B2 * 6/2017 Niwa ..... B43K 8/03
9,848,647 B2 * 12/2017 Memari ..... A24F 47/008
9,848,648 B2 * 12/2017 Memari ..... A24F 47/008
2002/0181997 A1 * 12/2002 Konose ..... B43K 5/02 401/224
2003/0081981 A1 * 5/2003 Iida ..... B43K 5/03 401/40
2003/0123921 A1 7/2003 Abbas
2004/0109721 A1 * 6/2004 Nowak ..... B43K 5/18 401/227
2005/0169691 A1 * 8/2005 Yamada ..... A45D 34/042 401/23
2007/0020032 A1 1/2007 Abbas
2007/0212159 A1 * 9/2007 Kurita ..... B43K 7/10 401/199
2008/0118297 A1 * 5/2008 Biegel ..... A45D 34/041 401/119
2009/0252547 A1 * 10/2009 Aebischer ..... B43K 5/14 401/195
2011/0103875 A1 * 5/2011 Huang ..... B43K 8/00 401/104
2013/0004231 A1 * 1/2013 Nakatani ..... B43K 8/02 401/198
2013/0078025 A1 3/2013 Turgeman et al.
2013/0233242 A1 * 9/2013 Feuerstein ..... B43K 8/003 118/200
2014/0161508 A1 * 6/2014 Davies-Smith ..... B43K 11/00 401/292
2017/0008330 A1 * 1/2017 Hui ..... B43K 8/003
2017/0246901 A1 * 8/2017 Nishitani ..... B43K 11/00

FOREIGN PATENT DOCUMENTS

DE 9304466 U1 5/1993
JP 650886 U 7/1994
JP 872469 A 3/1996
JP 9500339 A 1/1997
JP 2011173340 A 9/2011
JP 2012135916 A 7/2012
JP 201343304 A 3/2013
WO 9429125 A1 12/1994

* cited by examiner

INK FILLING TOOL

CROSS-REFERENCE TO RELATED APPLICATIONS

This application is the United States national phase of International Application No. PCT/JP2015/079097 filed Oct. 14, 2015, and claims priority to Japanese Patent Application No. 2014-212004 filed Oct. 16, 2014, the disclosures of which are hereby incorporated in their entirety by reference.

FIELD

The present invention relates to an ink filling tool for filling a pen having an ink reservoir configured to store a liquid ink with the ink.

BACKGROUND

Conventionally, there have been various types of pens used as writing tools, makeup kits, and the like, and examples thereof include a pen including: an ink reservoir configured to store a liquid ink; a pen tip configured to be capable of being impregnated with the ink and molded into a rod shape; a holder part having a through hole into which the pen tip is inserted so as to be movable in the axial direction; and a valve mechanism configured to open by the pen tip being pressed in the axial direction and circulate the ink from the ink reservoir toward the pen tip in an open state.

Such a pen can apply the ink with which the pen tip is impregnated to a coating target by bringing the pen tip into contact with the ink coating target. The pen of this type is configured so that, when the amount of the ink with which the pen tip is impregnated decreases, the valve mechanism is opened by pressing the pen tip, and the ink in the ink reservoir is supplied to the pen tip. Thus, the pen of this type allows the pen tip to be abundantly provided with the ink, as needed, so as to allow writing or the like to be favorably performed (see Patent Literature 1, for example).

CITATION LIST

Patent Literature

Patent Literature 1: JP H8-72469 A

SUMMARY

Technical Problem

By the way, the pen of this type is generally disposed of when the ink in the ink reservoir is run out, despite the fact that the pen tip and the valve mechanism are still usable.

In such a current situation, it is required to make the pen reusable by supplying the ink to the ink reservoir. In particular, when a pen is used over a long period of time, a user is accustomed to using the pen, and thus continuous use is desired.

It is therefore an object of the present invention to provide an ink filling tool capable of making a used pen reusable.

Solution to Problem

An ink filling tool according to the present invention is configured to replenish a pen with a liquid ink, the pen including: an ink reservoir configured to store the liquid ink;

a pen tip configured to be capable of being impregnated with the ink and molded into a rod shape; a holder part having a through hole into which the pen tip is inserted so as to be movable in the axial direction; and a valve mechanism interposed between the pen tip and the ink reservoir and configured to open by being pressed by the pen tip so as to open a communication path connecting the ink reservoir to the pen tip, the ink filling tool including: an ink tank having an internal space configured to store the liquid ink; and a cylindrical nozzle having an inner hole communicating with the internal space of the ink tank, the nozzle being insertable into the through hole, wherein the nozzle is configured to be capable of pressing the valve mechanism in a state of being inserted into the through hole, and the nozzle has an ink circulating part configured to communicate the inner hole with an outside in a direction orthogonal to the axis of the nozzle.

According to an aspect of the present invention, it is preferable that the ink filling tool further include an annular guide surrounding the nozzle and configured to be capable of being externally fitted to the holder part of the pen.

In this case, the configuration may be such that the nozzle has the inner hole opening at its distal end, and the ink circulating part is constituted by a recess formed on a distal end face of the nozzle.

DESCRIPTION OF EMBODIMENTS

Hereinafter, an embodiment of the present invention will be described with reference to the attached drawings.

First, a pen as a target to be filled with an ink using an ink filling tool according to this embodiment will be described.

Figure 1:
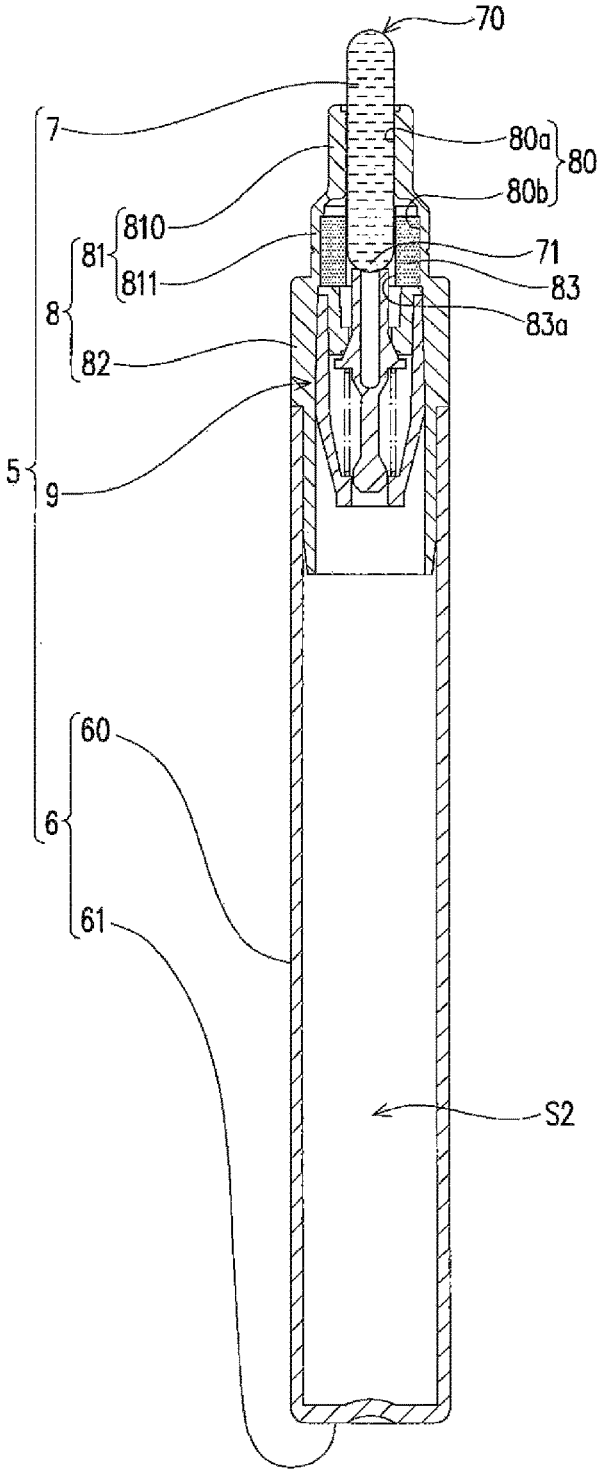
FIG. 1 is a sectional view of a pen as a target of an ink filling tool according to an embodiment of the present invention.

As shown in FIG. 1, such a pen includes an ink reservoir 6 configured to store a liquid ink, a pen tip 7 configured to be capable of being impregnated with the ink and molded into a rod shape, a holder part 8 having a through hole 80 into which the pen tip 7 is inserted so as to be movable in the axial direction, and a valve mechanism 9 interposed between the pen tip 7 and the ink reservoir 6.

The ink reservoir 6 includes a cylindrical peripheral wall 60 having one end and the other end, and a tail 61 closing the one end of the peripheral wall 60. The peripheral wall 60 and the tail 61 define an internal space S2 containing the ink.

Figure 2:
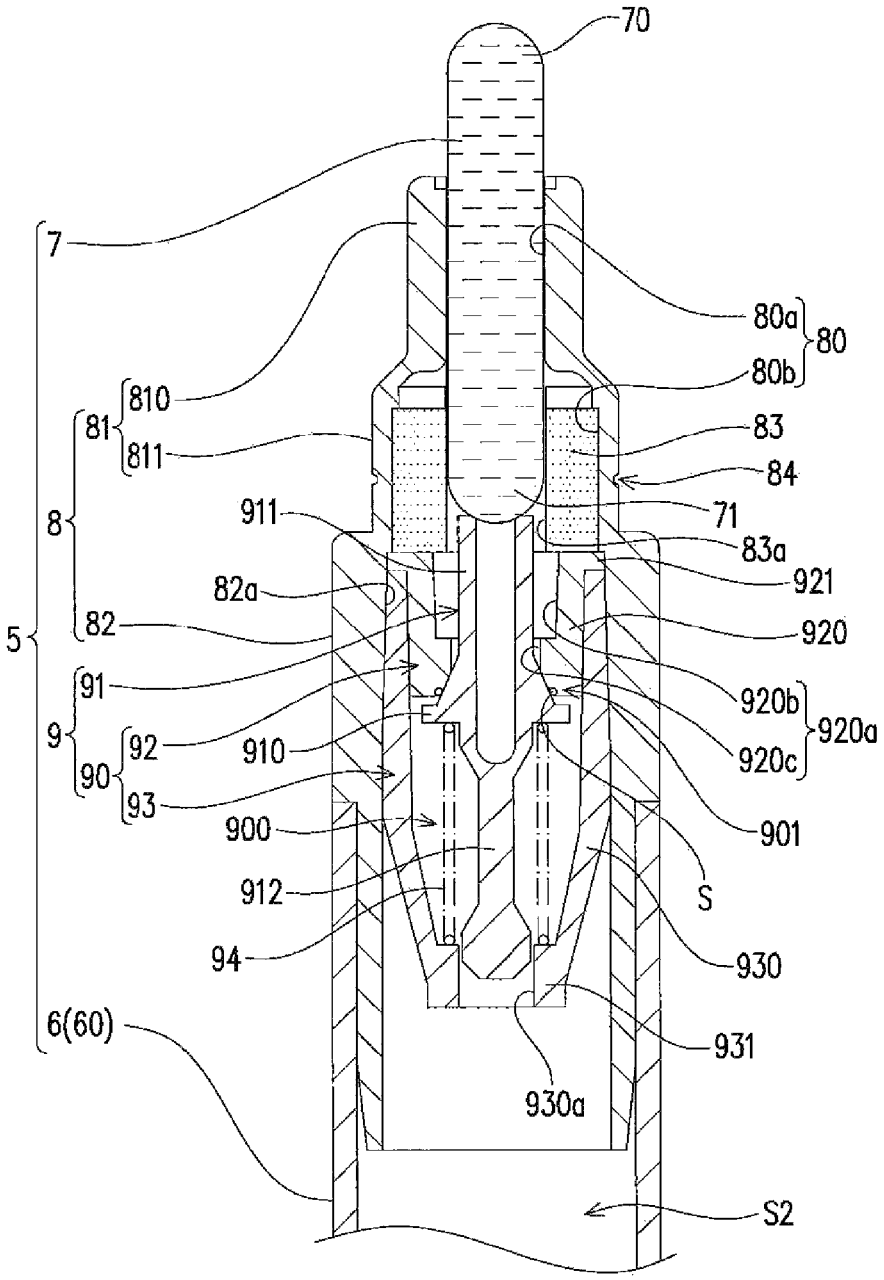
FIG. 2 is a partial enlarged sectional view of the target pen of the ink filling tool according to the embodiment.

As shown in FIG. 2, the pen tip 7 is formed into a rod shape and has one end in the axial direction serving as an application part 70 configured to apply the ink to an ink coating target and the other end in the axial direction serving as an ink supplying part 71 where the ink is supplied. The pen tip 7 is formed by molding a fiber material such as felt, non-woven fabric, cotton, and thread, and entirely has liquid absorbability.

The holder part 8 includes a pen tip holding part 81 having the through hole 80 into which the pen tip 7 is inserted. Further, the holder part 8 according to this embodiment includes a valve mechanism holding part 82 configured to hold the valve mechanism 9 and formed continuously with the pen tip holding part 81.

The pen tip holding part 81 is formed into a cylindrical shape. In this embodiment, the pen tip holding part 81 is formed into a stepped cylindrical shape. That is, the pen tip holding part 81 has a small diameter cylindrical part 810 and a large diameter cylindrical part 811 having a larger diameter than the small diameter cylindrical part 810 and formed continuously with the small diameter cylindrical part 810. Along with this, an inner hole 80*a* of the small diameter cylindrical part 810 and an inner hole 80*b* of the large diameter cylindrical part 811 are concentrically continuous with each other and form the through hole 80 through which the pen tip 7 is inserted. In this embodiment, the inner hole 80*a* of the small diameter cylindrical part 810 corresponds to the sectional shape and sectional size of the pen tip 7. That is, the inner circumferential surface defining the inner hole 80*a* of the small diameter cylindrical part 810 is formed to be capable of contacting the outer circumferential surface of the pen tip 7. Thereby, the pen tip 7 is inserted into the through hole 80 so as to be movable and insertable in the axial direction while its outer circumferential surface is guided by the inner circumferential surface of the small diameter cylindrical part 810.

In order to impregnate the pen tip 7 with the liquid ink, such a pen 5 generally includes a moisturizing member 83 arranged around the circumference of the pen tip 7 and configured to prevent drying of the pen tip 7. The moisturizing member 83 has liquid absorbability and is configured to be capable of being impregnated with the ink. That is, the moisturizing member 83 is formed by molding a fiber material such as felt, non-woven fabric, cotton, and thread, or a sponge body, and entirely has liquid absorbability. A sponge body is employed herein as the moisturizing member 83. The moisturizing member 83 has an inner hole 83*a* having the same diameter or substantially the same diameter as the inner hole 80*a* of the small diameter cylindrical part 810 and is fitted into the inner hole 80*b* of the large diameter cylindrical part 811 of the holder part 8 so that the inner hole 83*a* is concentric with the inner hole 80*a* of the small diameter cylindrical part 810.

Thus, the pen tip 7 is arranged extending over the inner hole 80*a* of the small diameter cylindrical part 810 and the inner hole 83*a* of the moisturizing member 83, with the application part 70 projecting outwardly from the small diameter cylindrical part 810.

The valve mechanism holding part 82 is formed into a cylindrical shape and has one end and the other end in the axial direction. The valve mechanism holding part 82 is formed to be capable of holding the valve mechanism 9 within an inner hole 82*a*.

In this embodiment, the valve mechanism holding part 82 is set to have a larger diameter than the large diameter cylindrical part 811 of the pen tip holding part 81, and has one end connected to the large diameter cylindrical part 811 (the pen tip holding part 81). In this embodiment, the other end side of the valve mechanism holding part 82 is fitted to the ink reservoir 6 (the other end of the peripheral wall 60). Thereby, the holder part 8 closes the other end side of the peripheral wall 60 of the ink reservoir 6 to seal the internal space S2 of the ink reservoir 6.

The valve mechanism 9 includes a valve body 90 having a communication path 900 connecting the through hole 80 to the ink reservoir 6 (the internal space S2) and having an annular valve seat 901 within the communication path 900, and a valve 91 arranged in the communication path 900 so as to be movable in the axial direction of the pen tip 7 and configured to abut the valve seat 901 by being biased toward the pen tip 7 side so as to close the communication path 900.

The valve body 90 includes a first member 92 having the annular valve seat 901, and a second member 93 having a valve guide 931 configured to guide the valve 91 and assembled with the first member 92.

The first member 92 includes a cylindrical body 920 which has an inner hole 920*a* constituting a part of the communication path 900 and has one end and the other end opposite to the one end, and a flange 921 which extends radially outwardly from the one end of the body 920 and has an outer diameter set to be substantially the same as the inner diameter of the inner hole 82*a* of the valve mechanism holding part 82.

The inner hole 920*a* of the body 920 is constituted by a large diameter hole 920*b* on one end side of the body 920 and a small diameter hole 920*c* which has a smaller diameter than the large diameter hole 920*b* and is continuous with the large diameter hole 920*b* on the other end side of the body 920.

The valve seat 901 is provided at the boundary between the inner circumferential surface defining the small diameter hole 920*c* and the other end face of the body 920. Specifically, the valve seat 901 includes an annular sealing member S, and the sealing member S is arranged on the open edge of the small diameter hole 920*c* on the other end face of the body 920.

The second member 93 includes a cylindrical body 930 having one end and the other end in the axial direction, having a length from the one end to the other end set larger than the length from the one end to the other end of the body 920, and having one end side configured to be capable of being externally fitted to the body 920 of the first member 92, and the annular valve guide 931 having a guide hole 930*a* into which the valve 91 (guided part 912, which will be described below) can be inserted and having an outer circumference connected to the other end of the cylindrical body 930.

The outer diameter of the cylindrical body 930 is set to be substantially the same as the inner diameter of the inner hole 82*a* of the valve mechanism holding part 82.

The cylindrical body 930 of the second member 93 is externally fitted to the body 920 of the first member 92, while the valve 91 and a biasing member (which is a coil spring herein) 94 configured to bias the valve 91 are arranged therein. In such a state, the valve guide 931 functions also as a spring holder configured to receive one end of the coil spring that is the biasing member 94.

Further, the outer diameter of the flange 921 and the outer diameter of the cylindrical body 930 are set to be substantially the same as the inner diameter of the inner hole 82*a* of the valve mechanism holding part 82, and therefore the assembled valve body 90 is fitted into the inner hole 82*a* of the valve mechanism holding part 82, thereby sectioning the through hole 80 of the holder part 8 in a liquid tight manner into the pen tip holding part 81 side and the opposite side.

The valve 91 includes a valve part 910 having one end and the other end, the one end side being capable of abutting the sealing member S of the valve seat 901, a pressed part 911 extending from the one end of the valve part 910 and configured to be inserted through the inner hole of the body 920 of the valve body 90, and the guided part 912 extending from the other end of the valve part 910 and arranged within the guide hole 930*a* of the valve body 90 (the second member 93).

The one end side of the valve part 910 is tapered, and the tapered surface is capable of being in tight contact with the entire circumference of the valve seat 901 (the sealing member S). The other end of the valve part 910 is biased by the biasing member 94 supported by the valve guide 931 serving as a spring holder. That is, the biasing member 94 is interposed between the valve part 910 and the valve guide 931 and biases the entire valve 91 toward the pen tip 7 side via the valve part 910.

The pressed part 911 is formed into a rod shape, and the distal end of the pressed part 911 is configured to support the ink supplying part 71 of the pen tip 7 inserted through the through hole 80 of the holder part 8. The outer diameter of the pressed part 911 is set to a smaller diameter than the small diameter hole 920*c* of the first member 92 of the valve body 90. Thus, a gap for circulating the ink can be formed between the inner circumferential surface defining the small diameter hole 920*c* and the outer circumferential surface of the pressed part 911. The pressed part 911 shown in the figure has a hole (not numbered) opening at the distal end and is configured to hold the ink also in the hole.

The guided part 912 is formed into a rod shape and has one end and the other end in the axial direction. The one end of the guided part 912 is connected to the other end of the valve part 910. The other end of the guided part 912 is arranged within the guide hole 930*a* of the valve guide 931. More specifically, the other end of the guided part 912 is set to have a larger diameter than the one end, and the outer circumferential surface is configured to be guided by the inner circumferential surface defining the guide hole 930*a*. The pressed part 911 and the guided part 912 are concentrically arranged.

The pen 5 which is premised by the ink filling tool according to this embodiment is as described above, in which the pen tip 7 (the application part 70) is pressed, so that the pressed part 911 of the valve mechanism 9 is pressed by the pen tip 7, thereby moving the valve part 910 of the valve 91 away from the valve seat 901 (the sealing member 5). That is, the pen 5 having the aforementioned configuration is configured to supply the ink in the ink reservoir 6 to the pen tip 7 by opening the valve mechanism 9.

Next, the ink filling tool according to this embodiment will be described.

Figure 3:
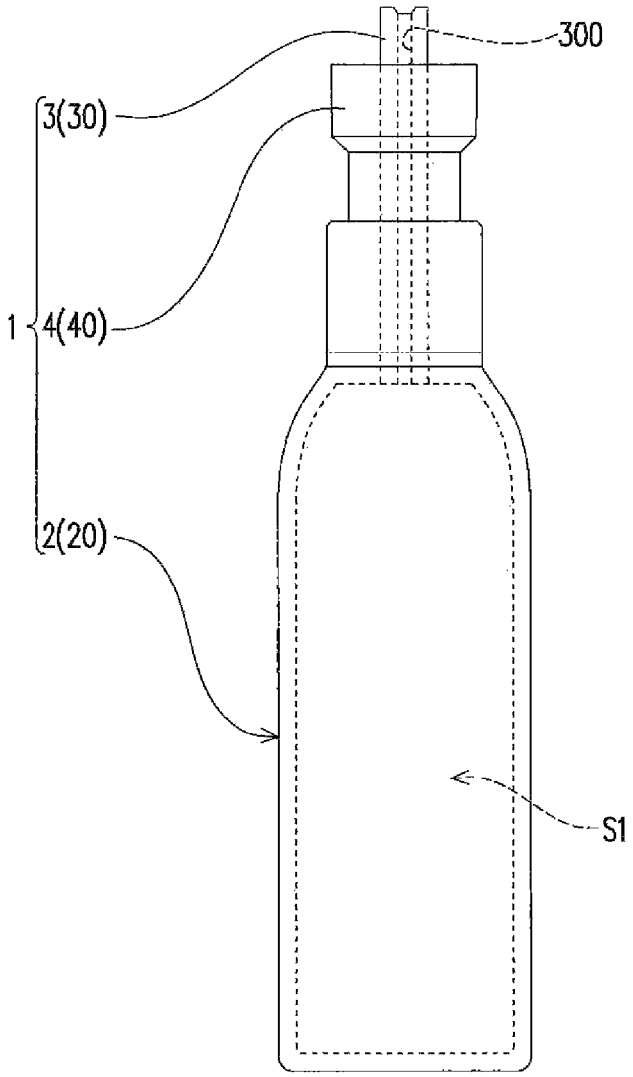
FIG. 3 is a front view of the ink filling tool according to the embodiment.
Figure 4:
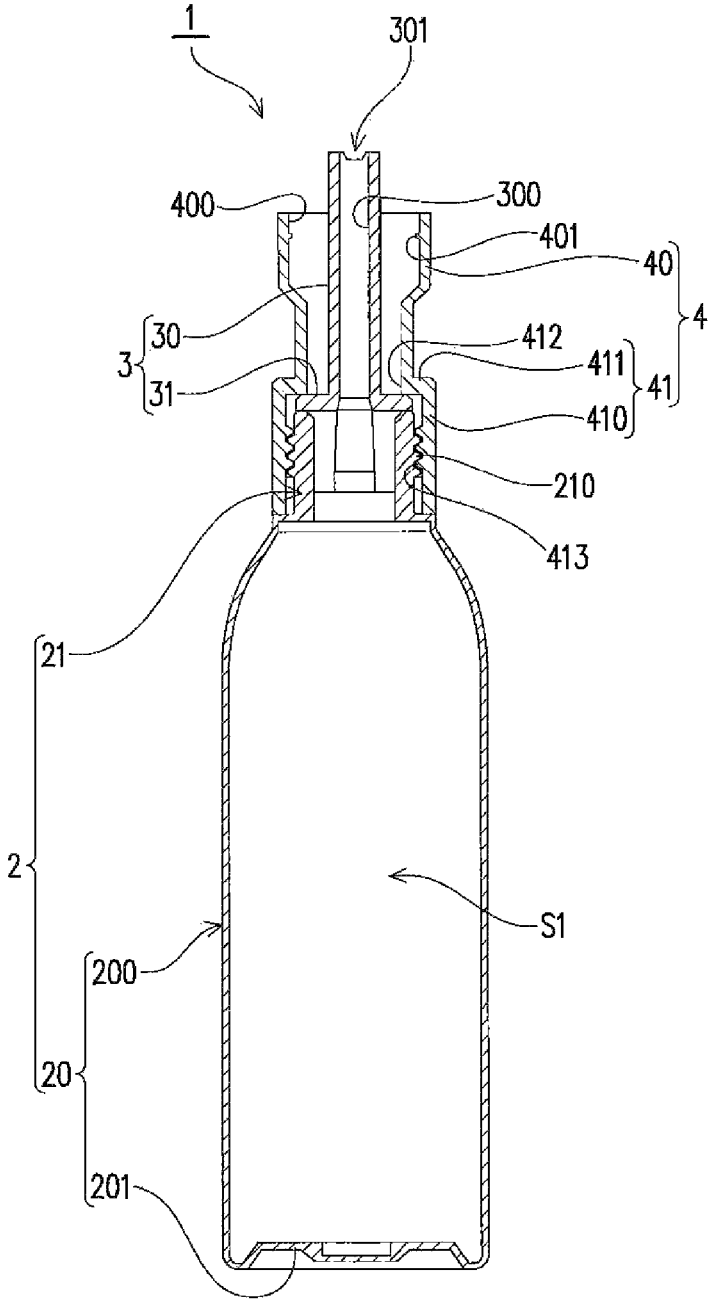
FIG. 4 is a sectional view of the ink filling tool according to the embodiment.

As shown in FIG. 3 and FIG. 4, the ink filling tool includes an ink tank 20 having an internal space S1 capable of storing a liquid ink, and a cylindrical nozzle 30 which has an inner hole 300 communicating with the internal space S1 of the ink tank 20 and can be inserted into the through hole 80. The ink filling tool 1 according to this embodiment further includes an annular guide 40 surrounding the nozzle 30 and configured to be capable of being externally fitted to the holder part 8 of the pen 5.

More specifically, as shown in FIG. 4, the ink filling tool 1 according to this embodiment includes a reservoir member 2 including the ink tank 20, a cylindrical member 3 including the nozzle 30, and a coupling member 4 coupling the cylindrical member 3 to the reservoir member 2 and including the guide 40.

The reservoir member 2 includes the ink tank 20, and a coupling part 21 connected to the ink tank 20 and configured to couple the cylindrical member 3 (the nozzle 30).

The ink tank 20 includes a cylindrical barrel 200 having one end and the other end, and a closure part 201 configured to close the one end of the barrel 200. In the ink tank 20, the barrel 200 and the closure part 201 define the internal space S1 containing the ink. The coupling part 21 is formed into a cylindrical shape, and is connected to the other end of the barrel 200. In this embodiment, the coupling part 21 is set to have a smaller diameter than the barrel 200. On the outer circumferential surface of the coupling part 21, an external thread 210 configured to threadedly engage the coupling member 4 is formed.

Figure 5:
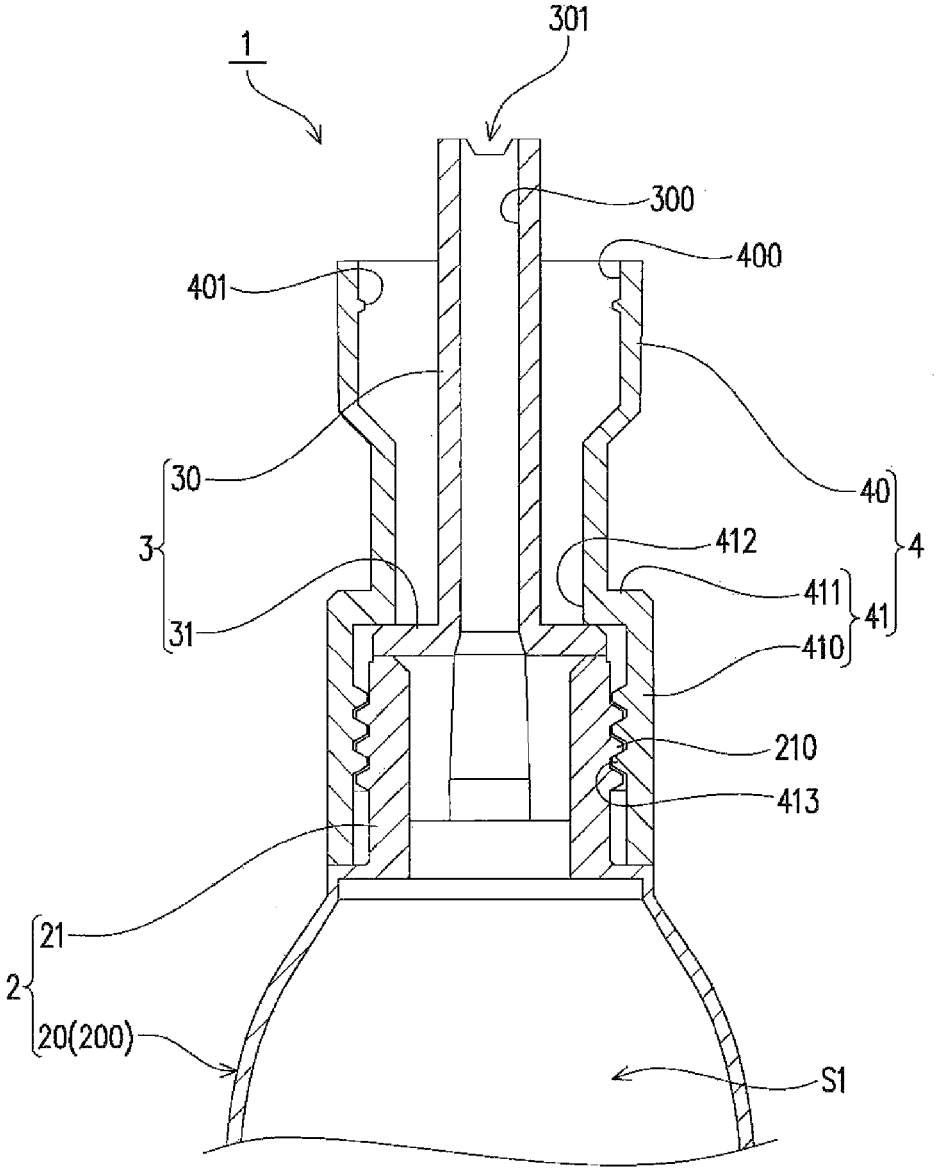
FIG. 5 is a partial enlarged sectional view of the ink filling tool according to the embodiment.

As shown in FIG. 4 and FIG. 5, the cylindrical member 3 includes the nozzle 30 having a distal end and a proximal end in the axial direction, and a fixing flange 31 extending radially outwardly from the proximal end of the nozzle 30 and configured to be fixed to the reservoir member 2.

The nozzle 30 is configured to be capable of pressing the valve 91 (the pressed part 911) of the pen 5 in the state of being inserted into the through hole 80 of the holder part 8 of the pen 5. Further, the nozzle 30 has an ink circulating part 301 communicating the inner hole 300 with the outside in a direction orthogonal to the axis of the nozzle 30.

A more specific description will be given. The outer diameter of the nozzle 30 is set to be substantially the same as the diameter of the through hole 80 of the holder part 8 of the pen 5. Thereby, the outer circumferential surface of the nozzle 30 is configured to be guided by the inner circumferential surface of the through hole 80 of the holder part 8 when the nozzle 30 is inserted into the through hole 80 of the holder part 8 of the pen 5.

The nozzle 30 is set to have a length so as to be capable of pressing the pressed part 911 of the valve 91 in the state of being inserted into the through hole 80 of the holder part 8 of the pen 5. That is, the length from the fixing flange 31 to the distal end of the nozzle 30 is set to be larger than the distance from the distal end of the pressed part 911 to the distal end of the holder part 8 from which the pen tip 7 extends to the outside in the state where the valve part 910 is in contact with the valve seat 901 (the sealing member S).

The inner hole 300 of the nozzle 30 opens at the distal end and the proximal end. That is, the inner hole 300 of the nozzle 30 is formed over the total length from the proximal end to the distal end of the nozzle 30.

The ink circulating part 301 is constituted by a recess formed on the distal end face of the nozzle 30. In this embodiment, such ink circulating parts 301 are provided at two points on the distal end face of the nozzle 30.

The inner diameter of the fixing flange 31 is set to be the same as the diameter of the inner hole 300 of the nozzle 30, and the outer diameter of the fixing flange 31 is set to be the same as the outer diameter of the coupling part 21.

The coupling member 4 includes a fixing part 41 configured to fix the fixing flange 31 of the cylindrical member 3 to the coupling part 21 of the reservoir member 2. In this embodiment, the coupling member 4 includes the guide 40 provided continuously with the fixing part 41, in addition to the fixing part 41.

The fixing part 41 is capable of threadedly engaging the coupling part 21 and pressing the fixing flange 31 of the cylindrical member 3 toward the coupling part 21 side by being stacked on the end face of the coupling part 21. Specifically, the fixing part 41 includes a cylindrical externally fitted part 410 which is threadedly engaged in the state of being externally fitted to the coupling part 21 and has one end and the other end in the axial direction, and a pressing part 411 which is connected to the one end of the externally fitted part 410 and defines an insertion hole 412 into which the nozzle 30 can be inserted.

On the inner circumference of the externally fitted part 410, an internal thread 413 capable of being threadedly engaged with an external thread 210 provided on the outer circumference of the coupling part 21 is formed.

The pressing part 411 extends radially inwardly from the entire circumference of the open edge at the one end of the externally fitted part 410. Thus, the pressing part 411 defines the insertion hole 412 into which the nozzle 30 of the cylindrical member 3 can be inserted. Further, the pressing part 411 is capable of being stacked on at least a part of the fixing flange 31 of the cylindrical member 3.

The guide 40 is formed continuously with the fixing part 41. The guide 40 is formed into a cylindrical shape capable of being externally fitted to the holder part 8 of the pen 5. Specifically, the guide 40 has an inner hole 400 into which the holder part 8 of the pen 5 can be inserted and is configured so that at least a part of the inner circumferential surface defining the inner hole 400 is guided by the outer circumferential surface of the holder part 8 of the pen 5. In this embodiment, the guide 40 is arranged concentrically with the fixing part 41 (the externally fitted part 410). The guide 40 is set to have a length so as not to interfere with the pen 5 (the holder part 8) until the distal end of the nozzle 30 presses the valve 91 of the pen 5.

In this embodiment, the guide 40 is provided with an engaging part 401 capable of engaging a part of the pen 5. More specifically, the guide 40 is provided with the engaging part 401 configured to engage a part of the pen 5 in the state where the valve mechanism 9 of the pen 5 is opened by the nozzle 30. The engaging part 401 is constituted by at least one of a recess and a projection and is configured to be fitted to at least the other of the recess and the projection existing on the outer circumference of the pen 5.

The ink filling tool 1 according to this embodiment is used for the pen 5 (the pen 5 having a recess 84 for engaging a cap which is not shown: see FIG. 2) having the recess 84 formed on the outer circumference of the holder part 8, and corresponding to this, a projection serving as the engaging part 401 is provided on the inner circumferential surface of the guide 40.

The coupling member 4 having the aforementioned configuration is configured so that, while the nozzle 30 of the cylindrical member 3 is inserted through the insertion hole 412 defined by the pressing part 411, and the pressing part 411 is stacked on the fixing flange 31 of the cylindrical member 3, the externally fitted part 410 is threadedly engaged with the coupling part 21, thereby allowing the pressing part 411 to sandwich the fixing flange 31 of the cylindrical member 3 together with the end face of the coupling part 21. That is, the externally fitted part 410 is threadedly engaged with the coupling part 21, and thereby the pressing part 411 is configured to be drawn to the coupling part 21 side to press the fixing flange 31. Thereby, the fixing flange 31 and the coupling part 21 are in tight contact (pressure contact) with each other to prevent fluid leakage (ink leakage) from between the cylindrical member 3 and the reservoir member 2.

In this way, when the cylindrical member 3 is fixed by the coupling member 4, the cylindrical member 3 is positioned by the inner circumferential surface defining the insertion hole 412 of the pressing part 411, and the nozzle 30 is arranged concentrically with the guide 40.

Figure 6:
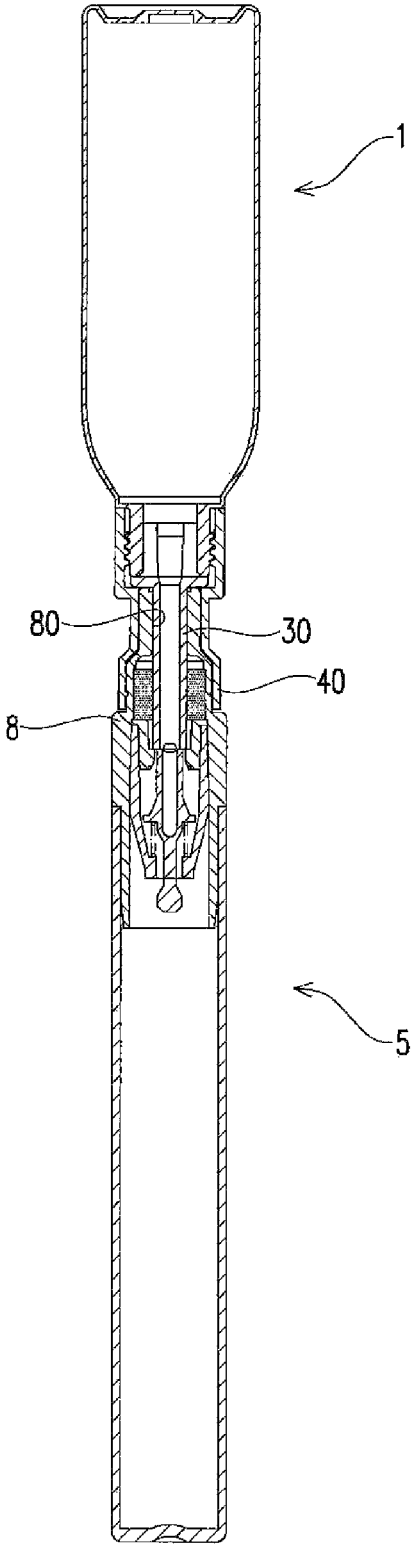
FIG. 6 is a sectional view of the ink filling tool according to the embodiment when it is connected to the target pen.
Figure 7:
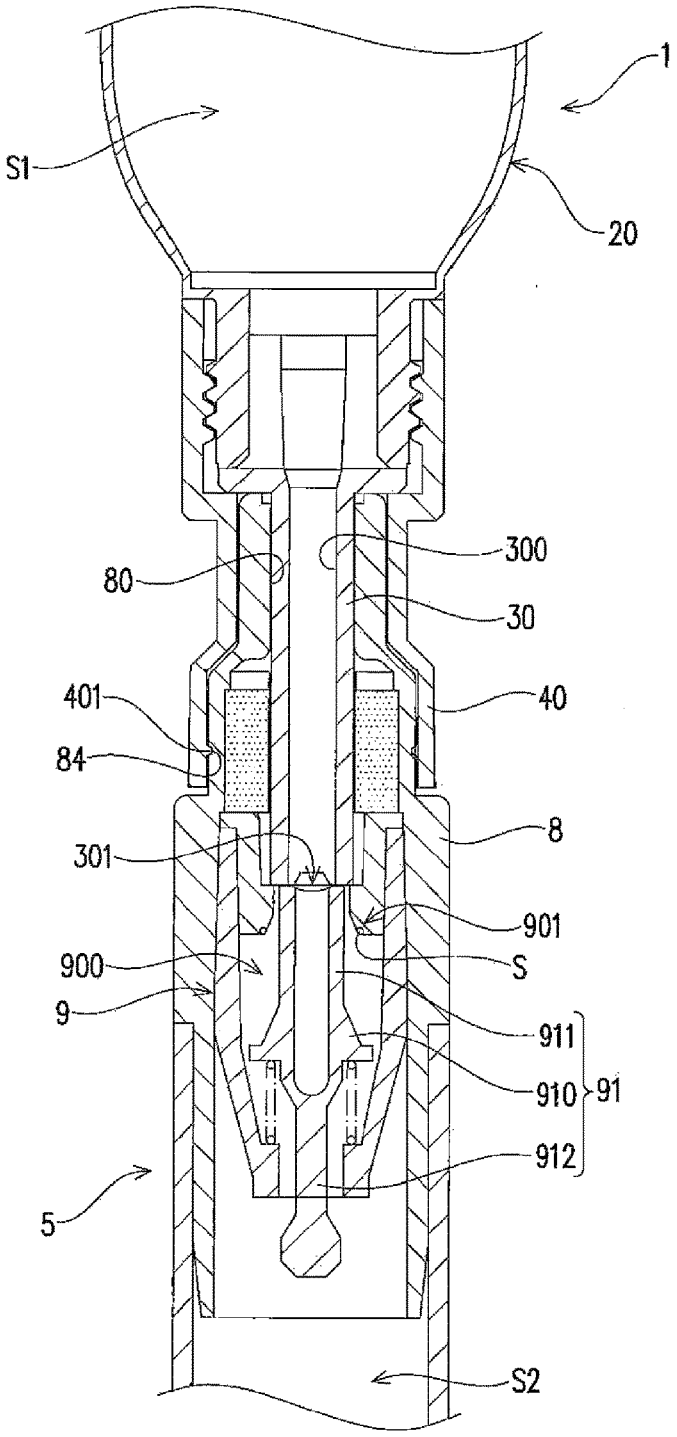
FIG. 7 is a partial enlarged sectional view of the ink filling tool according to the embodiment when it is connected to the target pen.

The ink filling tool 1 according to this embodiment is as described above. As shown in FIG. 6 and FIG. 7, after the pen tip 7 of the pen 5 to be filled with the ink is drawn out from the holder part 8 (the through hole 80), the nozzle 30 is inserted into the through hole 80 of the holder part 8 of the pen 5. At this time, the guide 40 is guided by the holder part 8 of the pen 5 so that the nozzle 30 enters straight into the through hole 80.

Then, when the nozzle 30 reaches the valve mechanism 9 of the pen 5 (the valve 91), and the entire ink filling tool 1 is pressed toward the pen 5 side, the nozzle 30 presses the valve 91 to open the valve mechanism 9, as shown in FIG. 7. That is, the valve part 910 moves away from the valve seat 901, and one side and the other side of the communication path 900 with the valve part 910 serving as a boundary communicate with each other.

In this embodiment, when the valve mechanism 9 is opened, the engaging part 401 of the guide 40 engages a part of the pen 5. That is, the projection serving as the engaging part 401 of the guide 40 is fitted to (engages) the recess 84 of the holder part 8 of the pen 5, and the state of the nozzle 30 pressing the valve 91 (the open state of the valve mechanism 9) is maintained.

This allows the internal space S1 of the ink tank 20 to communicate with the internal space S2 of the ink reservoir 6 via the inner hole 300 of the nozzle 30 which is present within the through hole 80 of the holder part 8, the ink circulating part 301, and the communication path 900 in the open state.

Accordingly, the ink filling tool 1 can allow the ink in the ink tank 20 to flow into the ink reservoir 6 via the inner hole 300 of the nozzle 30, the ink circulating part 301, and the communication path 900. In the ink filling tool 1 according to this embodiment, the internal space S1 of the ink tank 20 and the inner hole 300 of the nozzle 30 directly communicate with each other, and therefore it is necessary to supply the ink in the ink tank 20 to the pen 5 by free fall. Accordingly, as described above, when the ink in the ink tank 20 is supplied to the pen 5, the ink filling tool 1 according to this embodiment is arranged above the pen 5 (see FIG. 6).

When a necessary amount of ink has been supplied to the ink reservoir 6 of the pen 5, the entire ink filling tool 1 is moved so that the nozzle 30 is drawn out from the holder part 8 (the through hole 80). Then, pressing the valve 91 by the nozzle 30 is released. As a result, the valve 91 abuts the valve seat 901, and the communication path 900 in the valve mechanism 9 (the valve body 90) is closed, thereby preventing the leakage of the ink in the ink reservoir 6. Then, the pen tip 7 is inserted into the holder part 8 (the through hole 80), thereby making the pen 5 which has run out of the ink reusable.

As described above, the ink filling tool 1 is configured to replenish the pen 5 with a liquid ink. The pen 5 includes: the ink reservoir 6 configured to store the liquid ink; the pen tip 7 configured to be capable of being impregnated with the ink and molded into a rod shape; the holder part 8 having the through hole 80 into which the pen tip 7 is inserted so as to be movable in the axial direction; and the valve mechanism 9 interposed between the pen tip 7 and the ink reservoir 6 and configured to open by being pressed by the pen tip 7 so as to open the communication path 900 connecting the ink reservoir 6 to the pen tip 7. The ink filling tool 1 includes: the ink tank 20 having the internal space S1 configured to store the liquid ink; and the cylindrical nozzle 30 having the inner hole 300 communicating with the internal space S1 of the ink tank 20, the nozzle 30 being insertable into the through hole 80, wherein the nozzle 30 is configured to be capable of pressing the valve mechanism 9 in a state of being inserted in the through hole 80, and the nozzle 30 has the ink circulating part 301 communicating the inner hole 300 with an outside in a direction orthogonal to the axis of the nozzle 30.

Therefore, according to the ink filling tool 1 having the aforementioned configuration, after the pen tip 7 of the pen 5 to be filled with the ink is drawn out from the holder part 8 (the through hole 80), the nozzle 30 is inserted into the through hole 80 of the holder part 8 of the pen 5, and then the nozzle 30 reaches the valve mechanism 9 of the pen 5.

Then, when the entire ink filling tool 1 is pressed toward the pen 5 side, the nozzle 30 presses the valve mechanism 9, and the valve mechanism 9 is opened. This allows the internal space S1 of the ink tank 20 to communicate with the internal space S2 of the ink reservoir 6 via the inner hole 300 of the nozzle 30 which is present within the through hole 80 of the holder part 8, the ink circulating part 301, and the communication path 900 in the open state.

More specifically, the flow path of the ink is blocked, if the inner hole 300 of the nozzle 30 is formed extending straight from the ink tank 20 to be closed at the distal end of the nozzle 30, or the inner hole of the nozzle 30 is formed extending straight from the ink tank 20 to open at the distal end of the nozzle 30 and to be closed by pressing the valve mechanism 9.

However, the nozzle 30 of the ink filling tool 1 having the aforementioned configuration has the ink circulating part 301 communicating the inner hole 300 with the outside in a direction orthogonal to the axis of the nozzle 30, and therefore the inner hole 300 of the nozzle 30 and the communication path 900 in the open state communicate with each other via the ink circulating part 301 located at a different position from the distal end of the nozzle 30, so that the ink tank 20 and the ink reservoir 6 eventually communicate with each other.

Thereby, the ink filling tool 1 can allow the ink in the ink tank 20 to flow into the ink reservoir 6 via the inner hole 300 of the nozzle 30, the ink circulating part 301, and the communication path 900.

Then, when a necessary amount of ink has been supplied to the ink reservoir 6 of the pen 5, the entire ink filling tool 1 is moved so that the nozzle 30 is drawn out from the holder part 8 (the through hole 80). Then, pressing the valve mechanism 9 by the nozzle 30 is released. As a result, the communication path 900 in the valve mechanism 9 is closed, thereby preventing the leakage of the ink in the ink reservoir 6. Then, the pen tip 7 is inserted into the holder part 8 (the through hole 80), thereby making the pen 5 which has run out of the ink reusable.

Further, since the ink filling tool 1 according to this embodiment further includes the annular guide 40 surrounding the nozzle 30 and configured to be capable of being externally fitted to the holder part 8 of the pen 5, the guide 40 is guided by the outer circumference of the holder part 8 when the nozzle 30 is inserted into the through hole 80 of the holder part 8 of the pen 5. Accordingly, the nozzle 30 can be appropriately and reliably inserted into the through hole 80 of the holder part 8.

In particular, the inner hole 300 of the nozzle 30 opens at the distal end, and the ink circulating part 301 is constituted by a recess formed on the distal end face of the nozzle 30, and therefore when the nozzle 30 presses the valve 91, the inner hole opening at the distal end of the nozzle 30 is closed by the valve 91, and the opening of the ink circulating part (recess) 301 is closed by the valve 91. Accordingly, the ink circulating part 301 forms a hole shape, so that the ink can flow outwardly through the inner hole.

The present invention is not limited to the aforementioned embodiment, and modifications can be appropriately made without departing from the gist of the present invention.

In the aforementioned embodiment, the pen 5 as a target of the ink filling tool 1 which includes the ink reservoir 6 and the holder part 8 formed as separate members is mentioned as an example, but there is no limitation to such a configuration. For example, the ink reservoir 6 and the holder part 8 may be integrally formed. That is, the holder part 8 of the pen 5 as a target of the ink filling tool 1 according to the present embodiment means the distal end of the pen 5 from which the pen tip 7 is exposed, and may be formed integrally or separately in relation to other configurations.

Further, the valve mechanism 9 or the like is also not limited to the configuration described in the aforementioned embodiment, and the pen 5 may include the valve mechanism 9 having a different configuration from the configuration described in the aforementioned embodiment. That is, the pen 5 as a target of the ink filling tool 1 according to the present embodiment needs only to include the valve mechanism 9 interposed between the pen tip 7 and the ink reservoir 6 and configured to open by being pressed by the pen tip 7 so as to open the communication path 900 connecting the ink reservoir 6 to the pen tip 7.

The point is that the pen 5 as a target of the ink filling tool 1 according to the present embodiment needs only to include: the ink reservoir 6 configured to store the liquid ink; the pen tip 7 configured to be capable of being impregnated with the ink and molded into a rod shape; the holder part 8 having the through hole 80 into which the pen tip 7 is inserted so as to be movable in the axial direction; and the valve mechanism 9 interposed between the pen tip 7 and the ink reservoir 6, wherein the valve mechanism 9 includes: the valve body 90 which has the communication path 900 connecting the through hole 80 to the ink reservoir 6 and has the annular valve seat 901 within the communication path 900; and the valve 91 which is arranged within the communication path 900 so as to be movable in the axial direction of the pen tip 7 and is configured to abut the valve seat 901 by being biased toward the pen tip 7 side so as to close the communication path 900, and the valve mechanism 9 is configured to open by the pen tip 7 being pressed in the axial direction and the pen tip 7 pressing the valve 91.

In the aforementioned embodiment, the guide 40 configured to be capable of being externally fitted to the holder part 8 of the pen 5 is provided, and the guide 40 is guided by the holder part 8 of the pen 5 when the nozzle 30 is inserted into the through hole 80 of the pen 5, but there is no limitation to such a configuration. For example, the nozzle 30 may be simply inserted into the through hole 80 of the holder part 8 of the pen 5 without providing the guide 40. That is, the ink filling tool 1 needs only to include at least the ink tank 20 and the nozzle 30.

Figure 8:
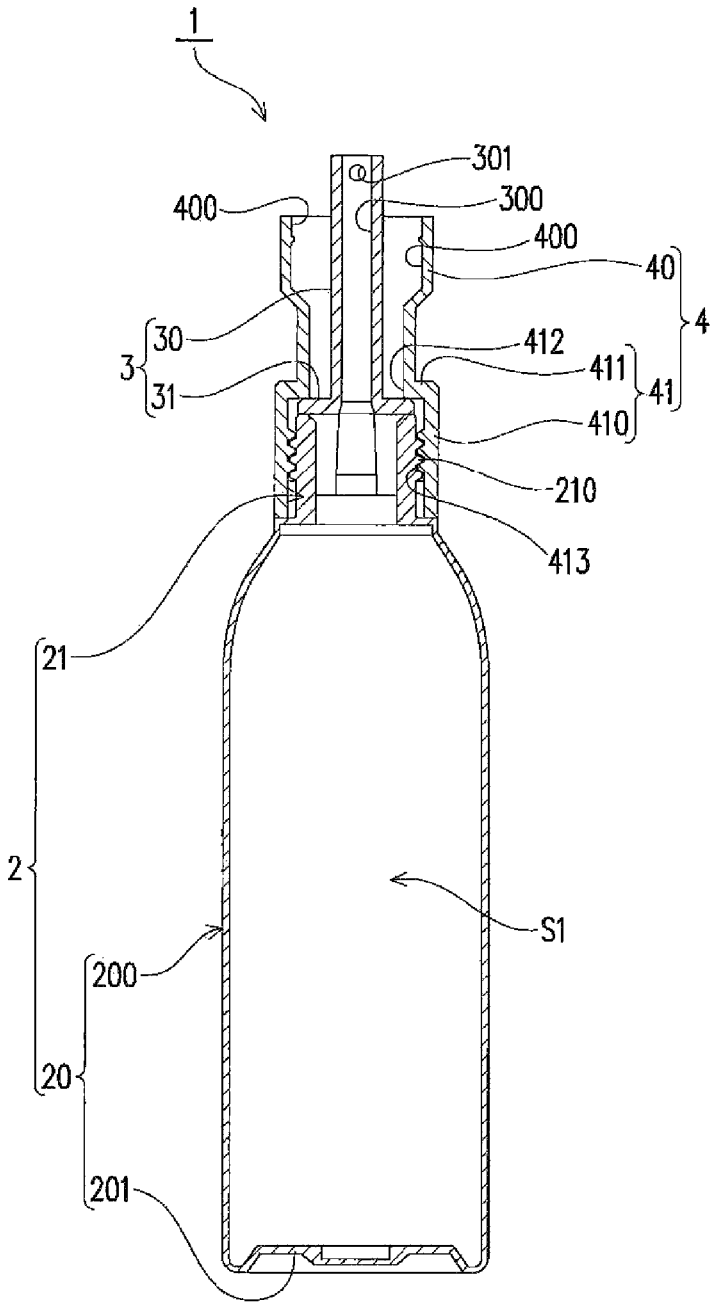
FIG. 8 is a sectional view of an ink filling tool according to another embodiment of the present invention.

In the aforementioned embodiment, the ink circulating part 301 is constituted by the recess provided at the distal end of the nozzle 30, but there is no limitation to such a configuration. For example, as shown in FIG. 8, the ink circulating part 301 may be provided at a halfway position in the nozzle 30. That is, the ink circulating part 301 may be a hole communicating the inner hole 300 of the nozzle 30 with the outside. However, it is needless to say that the ink circulating part 301 is arranged at a position in the pen 5 so as to be capable of opening in the state where the nozzle 30 is inserted into the through hole 80 of the holder part 8 of the pen 5.

In the aforementioned embodiment, the ink filling tool 1 has the ink tank 20, the nozzle 30, and the guide 40 which are respectively configured as parts of separate members, and is formed by assembling these members, but there is no limitation to this. The ink tank 20 and the nozzle 30 may be integrally molded, or the ink tank 20, the nozzle 30, and the guide 40 may be integrally molded.

In the aforementioned embodiment, the guide 40 includes the engaging part 401 configured to engage a part of the pen 5, but there is no limitation to such a configuration. For example, in the case of providing the guide 40, the guide 40 may have a function to be simply guided by the holder part 8 of the pen 5. However, in order to maintain the open state of the valve mechanism 9 of the pen 5, it is necessary to cause a pressing force to act against the biasing force of the biasing member 94, and therefore it is preferable to provide the engaging part 401 capable of fixing a relative position between the pen 5 and the ink filling tool 1 as in the aforementioned embodiment.

In the aforementioned embodiment, the projection serving as the engaging part 401 is fitted to the recess existing in the holder part 8, but there is no limitation to such a configuration. For example, in the case of providing the guide 40 and the engaging part 401 in the guide 40, a projection which can be fitted to a recess formed at the boundary between the ink reservoir 6 and the holder part 8 may be provided in the guide 40. Further, in the aforementioned embodiment, the projection serving as the engaging part 401 capable of being engaged with (being fitted to) the recess existing in the pen 5 is provided, but there is no limitation to such a configuration. For example, a recess serving as the engaging part 401 capable of engaging the projection existing in the pen 5 may be provided in the guide 40. Further, a recess and a projection serving as such engaging parts 401 capable of engaging the projection and the recess existing in the pen 5 may be provided in the guide 40.

REFERENCE SIGNS LIST

1: Ink filling tool
2: Reservoir member
3: Cylindrical member
4: Coupling member
5: Pen
6: Ink reservoir
7: Pen tip
8: Holder part
9: Valve mechanism
20: Ink tank
21: Coupling part
30: Nozzle
31: Fixing flange
40: Guide
41: Fixing part
60: Peripheral wall
61: Tail
70: Application part
71: Ink supplying part
80: Through hole
80*a*: Inner hole
80*b*: Inner hole
81: Pen tip holding part
82: Valve mechanism holding part
82*a*: Inner hole
83: Moisturizing member
83*a*: Inner hole
84: Recess
90: Valve body
91: Valve
92: First member
93: Second member
94: Biasing member
200: Barrel
201: Closure part
300: Inner hole
301: Ink circulating part
400: Inner hole
401: Engaging part
410: Externally fitted part
411: Pressing part
412: Insertion hole
810: Small diameter cylindrical part
811: Large diameter cylindrical part
900: Communication path
901: Valve seat
910: Valve part
911: Pressed part
912: Guided part
920: Body
920*a*: Inner hole
920*b*: Large diameter hole
920*c*: Small diameter hole
921: Flange
930: Cylindrical body
930*a*: Guide hole
931: Valve guide
S: Sealing member
S1: Internal space
S2: Internal space

The invention claimed is:

1. An ink filling tool configured to replenish a pen with a liquid ink, the pen comprising: an ink reservoir configured to store the liquid ink; a pen tip configured to be capable of being impregnated with the ink and molded into a rod shape; a holder part having a through hole into which the pen tip is inserted so as to be movable in the axial direction; and a valve mechanism interposed between the pen tip and the ink reservoir and configured to open by being pressed by the pen tip so as to open a communication path connecting the ink reservoir to the pen tip, the ink filling tool comprising:

an ink tank having an internal space configured to store the liquid ink; and a cylindrical nozzle having an inner hole communicating with the internal space of the ink tank, the nozzle being insertable into the through hole, wherein the nozzle is configured to be capable of pressing the valve mechanism in a state of being inserted into the through hole, and the nozzle comprises an ink circulating part configured to communicate the inner hole with an outside in a direction orthogonal to the axis of the nozzle.

2. The ink filling tool according to claim 1, further comprising:

an annular guide surrounding the nozzle and configured to be capable of being externally fitted to the holder part of the pen.

3. The ink filling tool according to claim 1, wherein the nozzle comprises the inner hole opening at its distal end, and the ink circulating part is constituted by a recess formed on a distal end face of the nozzle.

4. The ink filling tool according to claim 2, wherein the nozzle comprises the inner hole opening at its distal end, and the ink circulating part is constituted by a recess formed on a distal end face of the nozzle.

* * * * *